United States Patent [19]

Jahnen et al.

[11] Patent Number: 4,703,857

[45] Date of Patent: Nov. 3, 1987

[54] THIN-WALLED STACKABLE CONTAINER LID

[75] Inventors: Ludwig Jahnen, Urschmitt; Manfred Dahler, Buchel, both of Fed. Rep. of Germany

[73] Assignee: Bellaplast GmbH, Wiesbaden, Fed. Rep. of Germany

[21] Appl. No.: 932,297

[22] Filed: Nov. 19, 1986

[30] Foreign Application Priority Data

Jan. 20, 1986 [DE] Fed. Rep. of Germany ... 8601223[U]

[51] Int. Cl.[4] ..... B65D 21/00; B65D 85/62

[52] U.S. Cl. ..... 206/503; 206/520; 220/306; 220/380

[58] Field of Search ..... 206/503, 508, 519, 520; 220/306, 380

[56] References Cited

U.S. PATENT DOCUMENTS

| | | | |
|---|---|---|---|
| 3,112,841 | 12/1963 | Martinelli | 220/380 |
| 3,339,786 | 9/1967 | Biglin | 220/380 |
| 3,442,420 | 5/1969 | Edwards | 206/520 |
| 3,612,342 | 10/1971 | Rathburn | 220/380 |
| 3,724,710 | 4/1973 | Davis | 220/380 |
| 4,076,123 | 2/1978 | Davis | 206/503 |

*Primary Examiner*—George E. Lowrance

*Attorney, Agent, or Firm*—H. Gibner Lehmann; K. Gibner Lehmann

[57] ABSTRACT

The invention provides a stackable thermoplastic container lid having a U-section sealing rib receivable in a container opening. An outer circular flange on the lid has a depending snap rim provided with bevelled detent elements that can cammingly engage the flange of an identical underlying lid in response to transaxial forces applied to the underlying lid, thereby to lift the sealing rib of the upper lid out of the underlying lid so as to enable lateral bottom-feed of lids from a stack of the same.

7 Claims, 4 Drawing Figures

THIN-WALLED STACKABLE CONTAINER LID

BACKGROUND OF THE INVENTION

1. Field of the Invention

This invention relates to thin-walled container lids, and more particularly to stackable, hot-molded lids of foil-thin thermoplastic substance.

2. Description of the Related Art Including Information Disclosed Under 37 CFR §§1.97–1.99

Lids of the above type as heretofore produced usually were provided with circular peripheral sealing ribs of somewhat U-shaped cross section adapted to be introduced into container openings, said ribs having (1) inner circular leg portions or walls and (2) having outer circular leg portions or walls, the latter transitioning into circular outer flanges while the inner leg portions or walls transition into the actual lid body or closure wall. The two leg portions of a sealing rib also form an annular groove which is open at the top of the lid and which tapers to a smaller opening towards the top. Molded into the annular bottom wall of a sealing rib is an annular stacking ring means or configuration which projects slightly downwardly and is adapted to fit into the circular opening or slot formed by the annular groove of an underlying identical lid, such stacking ring means having annular concentric upright stacking seating surfaces disposed on both of its sides.

Stackable, thin-walled container lids of this kind as revealed in German Publication DE-GM No. 78 06 380 each have a ring-shaped, flat outwardly radially-extending peripheral flange which surrounds the sealing rib and serves as a retainer rim to be fused or sealed to the opening of the container. The stacking seating surfaces of these known lids are rounded at the bottom of the sealing rib and interact with correspondingly rounded edges of an underlying identical lid at those transition points of the latter which are disposed between the inner peripheral wall of the sealing rib and the lid bottom or body, and/or at the transition points which are disposed between the outer peripheral wall of the underlying sealing rib and the associated peripheral flange or retainer rim. This is for the purpose of enabling the lowermost lid of a stack of lids to be readily forcibly laterally pushed or fed out of the remainder of the stack.

However, these known configurations cannot operate with lids of the snap type, i.e. those container lids which have, at their outer peripheries, locking rim portions that are folded down axially, gripping over the opening rims of the containers.

In addition, the prior configurations provided in the stackable, thin-walled container lids revealed in German Publication DE-GM No. 78 06 380 have the drawback that the axial load bearing capacity of the stacked, cooperable seating surfaces is relatively small due to the rounding of the transition points at such transition surfaces and the rounded transitions of the peripheral sealing rib walls to the actual lid bodies and peripheral flanges. Therefore, container lids of this known stacking type tend to jam at the mutually stacked sealing ribs when an excessive working axial pressure is exerted on a stack of such lids. This danger of mutual jamming of stacked container lids makes it virtually impossible to safely use such known lids in automatic container filling and sealing machines. For, if two stacked container lids were to jam, the feeding of the lids to the sealing station would be unquestionably interrupted. Such breakdown of the operation can then only be eliminated by costly means, and with considerable loss of time.

SUMMARY OF THE INVENTION

The above disadvantages and drawbacks of prior thin, stacking-type container lids are obviated by the present invention, and one object of the invention is to provide an improved lid of the kind above described but which has snap or locking rim portions, wherein when numbers of such lids are stacked, the lowermost lid can be readily pushed laterally out of the remainder of the stack without trouble being encountered from jamming or malformation, and with much greater safety.

Another object of the invention is to provide an improved stackable snap-type lid as above set forth, wherein a stack of such lids can readily withstand increased axial working pressures and loads.

Other features and advantages will hereinafter appear.

According to the invention these objects are accomplished by the provision of unique bevelled detent or locking elements in the snap rim of a container lid, such rim extending essentially downwardly and being adapted to lock over the peripheral rim of the container. The bevelled locking elements are so adapted to the height of the stacking ring means and with respect to the annular stacking seating surfaces of the lid that, when the elements slide over the transition rim of an identical underlying lid, the overlying stacking ring means readily is lifted out of the circular opening or slot formed by the annular groove in the top side of the ring in the lid below.

Due to the functional relationship of the stacking ring means of the present improved lid with the configurations of the bevelled locking elements and with an underlying transition rim on an adjacent underlying snap rim, the lowermost container lid of a stack can now be safely shifted laterally away from under the stack even when one or both of the stacking seating surfaces of an improved lid are of mostly planar configuration and when the transitions between the inner peripheral wall of the sealing rib and the actual lid body or between the outer peripheral wall of the sealing rib and the peripheral flange which supports the snap rim are of essentially sharp-edged shape. Thus, the measures provided for optimal stacking can be combined with the measures provided for safe unitary feeding of the lids when they are pushed laterally from the stack bottom.

The container lids made in accordance with the invention can be mass-produced economically in a simple manner; particularly, the lids can be removed from the hot-molding die without any problems during the manufacturing operation.

In the preferred embodiment of the invention, the transition points of a lid which are located between the outer leg portion or outer peripheral wall of the sealing rib and the circular flange are constituted as a sharp-edged rim, and the transition points between the stacking ring means and the outer stacking seating surfaces are constituted as a sharp-edged fillet. Due to this organization, the load-carrying elements which interact for the stacking of the container lids, according to the invention, are especially well suited for the transmission of considerable axial forces without deformation or changes in their mutual positions, thereby assuring a safe and secure, troublefree stacking.

In a second embodiment of the invention, to facilitate the lifting of the stacking ring means of a lid out of the annular groove on the top side of the sealing rib of an underlying lid during the interaction between the bevelled locking elements and the underlying cooperable transition rim of the snap rim below, the stacking ring means of the improved lid, at its outer periphery has bulges or radii which are convex towards the bottom. In such second embodiment, the transition points between the inner leg portion or inner peripheral wall of the sealing rib and the actual lid or closure body wall are constituted as a sharp-edged rim, and the transition points between the stacking ring means and the inner stacking seating surfaces are constituted as a sharp-edged fillet.

In this second embodiment of the invention, the inner stacking seating surfaces and the transition points of an underlying lid which are located between the inner peripheral wall of the sealing rib and the actual lid closure wall or body of the underlying lid are utilized as active the stacking elements. In this second embodiment of the invention, the stacking ring means preferably are constituted to be rounded at the inner circumference, with bulges or radii that are convex towards the bottom.

In a third embodiment of the invention, the structures described above for both of the first two embodiments can be combined.

It is within the scope of the invention to provide that, in any of the above-described embodiments, the sealing ribs be constituted with convex bulges or radii which are convex towards the bottom at the transition points between the inner stacking seating surfaces and the inner leg portion or inner peripheral wall; and/or at the transition points between the outer stacking seating surfaces and the outer leg portion or outer peripheral wall. These convex bulges or radii at one or the other, or at both the stacking seating surfaces and the peripheral walls of the sealing rib constitute spring elements which act in axial directions and are capable of elastically absorbing axial shocks exerted on stacks of container lids made according to the invention. Such supplementary measures also increase the stack safety substantially without making more difficult the pay-out or feeding of the lids, i.e. the sliding of the lowermost lids out from under a stack.

One embodiment or example of the invention is explained below in greater detail with reference to the drawing, in which.

Figure 1:
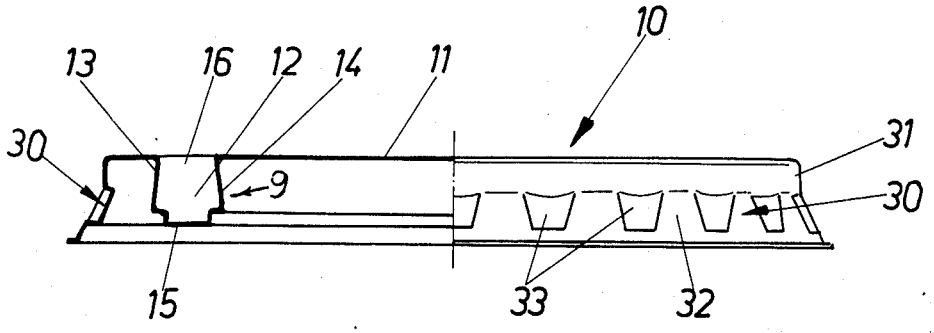
FIG. 1 is a side elevation of a container lid made according to the invention, partially sectioned.
Figure 2:
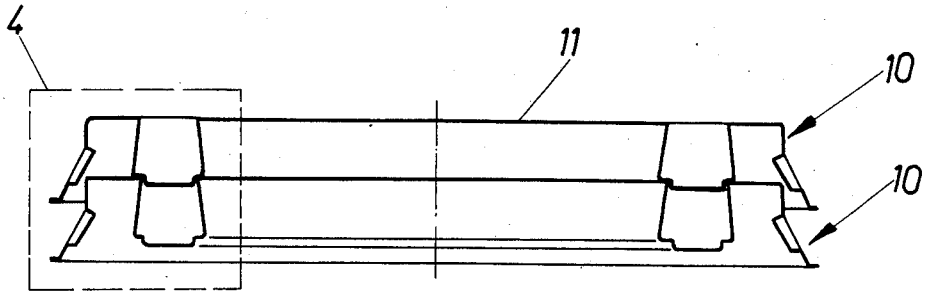
FIG. 2 is a vertical section of two lids made according to the invention, placed on top of each other.

The example of the invention illustrated herein comprises a thin-walled, thermoplastic, e.g. PVC, container lid 10, which, according to the invention, is provided with a peripheral snap rim 30 projecting axially downward. The lid 10 has an annular sealing rib 9, and both the rim 30 and the rib 9 concentrically surround the actual lid closure wall or body 11.

The sealing rib 9 is formed by an outer peripheral wall or outer leg 13, an inner peripheral wall or inner leg 14, and an annular bottom wall 15. The outer leg 13 and the inner leg 14 approach each other towards the top so that the sealing rib 9 encloses an annular groove (12) tapering to a smaller width towards the top. This annular groove of the sealing rib is open at the top of the lid, forming an annular opening or slot 16.

Figure 4:
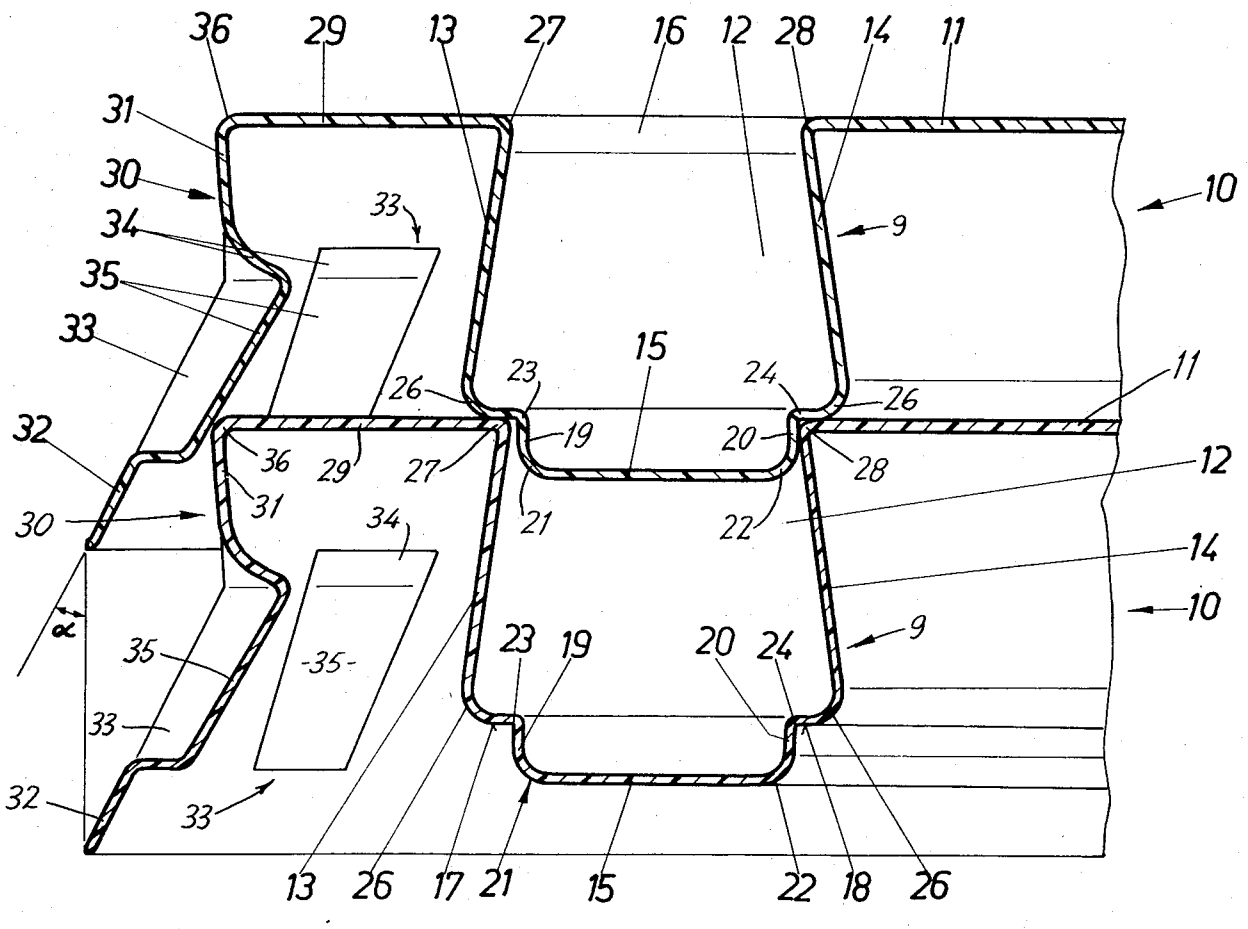
FIG. 4 is a greatly enlarged fragmentary section of the area indicated by the numeral 4 of FIG. 2.

As is evident from FIG. 4, two annular stacking seating surfaces, namely an outer stacking seating surface 17 and an inner stacking seating surface 18, are molded into the annular bottom wall 15 of the lid. The stacking seating surfaces 17 and 18 are displaced upwardly relative to the plane of the bottom wall 15 by means of stacking ring means 19 and 20, comprising an outer stacking ring 19 and an inner stacking ring 20. As the drawing shows, particularly in FIG. 4, the radial width of the stacking seating surfaces 17 and 18 in relation to the upward taper of the sealing rib 9 is such that the part of the bottom wall 15 which is located between the stacking seating surfaces 17 and 18 and which projects downwardly fits into the opening or slot 16 of a lid 10 which is disposed thereunder.

It is further evident from the drawings that the transitions, or transition points, between the bottom wall 15 and the stacking ring means 19 and 20 are formed by two essentially cylindrical, concentric wall parts 21 and 22. On the inside of the stacking ring 20, towards the inner stacking seating surface 18, a sharp-edged fillet 24 is formed as a transition or locus of transition points. A corresponding sharp-edged fillet 23 is also provided as a transition from the outer stacking ring wall 19 to the outer stacking seating surface 17. The transition from the outer stacking seating surface 17 to the outer leg or outer peripheral wall 13 of the sealing rib 9 is rounded in the form of a bulge or radius 26 which is convex towards the bottom. Correspondingly, the transition of the inner stacking seating surface 18 to the inner leg or inner peripheral wall 14 of the sealing rib 9 is rounded in the form of a bulge or radius 26, which is convex towards the bottom. Also, the transition of the inner peripheral wall 14 of the sealing rib 9 to the actual lid wall or body 11 is constituted as a sharp-edged rim 28. A corresponding sharp-edged rim 27 is formed at the transition of the outer leg or outer peripheral wall 13 of the sealing rib 9 to the annular flange 29. As FIG. 4 shows, the sharp-edged rims 27 and 28 engage or essentially engage the sharp-edged fillets 23 and 24 which are located between the stacking rings 19 or 20 and the stacking seating surfaces 17 or 18, respectively. Safe seating of the stacking seating surfaces 17 and 18 on the cooperable annular seating surface areas of the actual lid wall or body 11 and on the flange 29 at those points adjacent to the sharp-edged rims 27 and 28 is thus achieved in an advantageous manner. The bulges or radii 26 formed at the lower end areas of the outer leg 13 and inner leg 14 of the sealing rib 9 are suited to generate an elastic support action so that when an axial pressure or an axial shock is exerted on a stack of lids, a certain elastic flattening of these bulges or radii 22 and 26 can occur, rather than a broadening of the stacking seating surfaces 17 and 18.

As the drawing shows, the annular flange 29 transitions at its outer periphery into the snap rim 30. This snap rim 30 has at its upper area an essentially cylindrical wall ring 31 which, however, transitions into a taper wall ring 32 expanding in downward direction by an angle alpha of e.g. about 25° to 27°.

Figure 3:
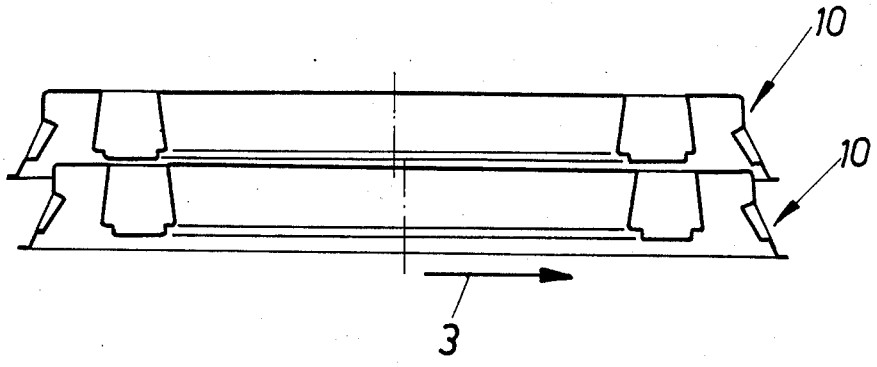
FIG. 3 is a vertical section of two lids made according to the invention, placed on top of each other, the lower lid being slightly displaced edgewise in the direction of the arrow 3 (to the right)

In accordance with the present invention, integrally molded into the tapered wall ring 32 are mutually spaced detention or detent elements 33 which project inwardly in the form of protrusions, forming upper detention walls 34 which extend radially inwardly of the peripheral wall 30, further insuring the seal for the container which is to be closed. The back walls 35 of these detent elements 33 are inclined somewhat more than the angle alpha. Also, the back walls 35 of the detent elements 33 are disposed at approximately the same radial distances from the sharp-edged fillets 23 which are disposed between the outer stacking seating ring 19 and the outer stacking seating surface 17, as the width of the flange 29. Thus, when container lids 10 are stacked on top of each other, the inner boundaries of the flanges 29, i.e. the sharp edges 27, are disposed at or engaged with overlying sharp-edged fillets 23 and the adjoining boundaries 26 thereof, whereas the slightly rounded transitions 36 rest against the inside surfaces of the back walls 35 of the detent elements 33. If the lowermost container lid 10 of a stack is moved in the direction of the arrow 3 in FIG. 3, or the arrow 4 in FIG. 4, the outer peripheral rims of the flanges 29, i.e. the transitions 36 at the snap rims 30, are pushed against the inclined inner surfaces of the back walls 35 of one or several adjacent stacking detent elements 33. This causes a raising, wedging action to be exerted on the overlying snap rim 30 in the area of one or more of the stacking elements 33 whereby the upper container lid 10, and with it the entire stack, is lifted until the peripheral rim, i.e. the transition 36 from the flange 29 to the snap rim 30, reaches the lower ends of the back walls 35 of the respective detent element or elements 33. At the same time, the sealing rib 9 of the upper container lid 10 is lifted by its stacking rings 19 and 20 out of the opening or slot 16 of the sealing rib 9 of the lower container lid, at least so far that the sharp edges 28 at the inner peripheries of the opening or slot 16 move from the area of the sharp fillet 24 into the area of the bulges or radii 22 which are convex towards the bottom. Thus, the further wedging action to lift the next to the lowest container lid and the stack on top of it, is taken over by the interaction of the sharp edge 28 with the bulge or radius 22. During this further lifting, the pair of stacking rings 19 and 20 of the second lowest lid is lifted out of the underlying annular opening or slot 16 over the entire circumference, while a corresponding interaction occurs between the outer, sharp-edged rim 27 of the opening or slot 16 with the bulge or radius 21 on the container lid opposite to the direction of the arrows 3 or 4. When the sealing rib 9 of the second lowest container lid is lifted by its stacking rings 19 and 20 out of the opening or slot 16 at the top of the lowest lid, the bottom wall 15 on the sealing rib 9 of the second lowest container lid will slide over the annular flange 29 and over the actual lid wall or body 11 of the lowest lid until the outermost rim area of the tapered wall part 32 of the snap rim 30 is lifted by wedge action over the outer peripheral rim, namely the transition 36 between the annular flange 29 and the snap rim 30 of the lowermost container lid. Only then is the lowermost container lid completely free of the stack. An additional safety against unintentionally moving the lowermost container lid out is thus also created.

Other variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A thin-walled stackable container lid (10) constituted of hot-molded foil-thin thermoplastic substance, said lid (10) having a circular peripheral sealing rib (9) of somewhat U-shaped cross section for introduction into an opening of a container, the outer leg portion (13) of the sealing rib (9) transitioning with a circular flange (29) and the inner leg portion (14) of the sealing rib (9) transitioning with the actual lid body (11), said two leg portions (13, 14) forming an annular groove (12) which is open at the top of the lid (10) and which tapers to a smaller width towards the top, the annular bottom wall (15) of the sealing rib (9) having, molded in it, stacking ring means (19, 20) which project downwardly and are receivable in the opening slot (16) of the annular groove (12) of an identical underlying lid (10), said sealing rib (9) having annular stacking seating surfaces (17, 18) which are coextensive with said stacking ring means (19, 20), characterized in that there is provided on the circular flange (29) transitioning from the sealing rib (9) an outer peripheral transition rim (36) and a snap rim (30) connected to said transition rim (36) and extending essentially axially downward therefrom, said snap rim (30) having bevelled detention elements (33) for camming engagement with a transition rim (36) of an identical underlying lid (10), thereby to lift the stacking ring means (19, 20) of the overlying lid (10) out of the annular groove (16) of the underlying lid (10) in response to transaxial forces applied to the underlying lid (10).

2. A container lid according to claim 1, characterized in that the transition of the outer leg (13) of the sealing rib (9) to the flange (29) is constituted as a sharp-edged rim (27), and the transition from the outer wall (19) of the stacking ring means (19, 20) to the outer stacking seating surface (17) is constituted as a sharp-edged fillet (23).

3. A container lid according to claim 2, characterized in that the stacking ring means (19, 20) is constituted at its outer periphery to have a radius (21) which is convex towards the bottom.

4. A container lid according to claim 1, characterized in that the transition of the inner leg (14) of the sealing rib (9) to the actual lid wall (11) is constituted as a sharp-edged rim (28) and the transition from the inner wall (20) of the stacking ring means (19, 20) to the inner stacking seating surface (18) is constituted as a sharp-edged fillet (24).

5. A container lid according to claim 4, characterized in that the stacking ring means (19, 20) is constituted at its inner periphery to have a radius (22) which is convex towards the bottom.

6. A container lid according to claim 1, characterized in that the sealing rib (9) is constituted at the transition from the inner stacking seating surface (18) to the inner leg (14) of the sealing rib (9) with a radius (26) which is convex towards the bottom.

7. A container lid according to claim 1, characterized in that the sealing rib (9) is constituted at the transition from the outer stacking seating surface (17) to the outer leg (13) of the sealing rib (9) with a radius (26) which is convex towards the bottom.

* * * * *